United States Patent [19]

Fukase

[11] Patent Number: 4,506,742

[45] Date of Patent: Mar. 26, 1985

[54] VIBRATIONLESS PERCUSSION TOOL

[75] Inventor: Yutaka Fukase, Kamagaya, Japan

[73] Assignee: M Group Corporation, Newport Beach, Calif.

[21] Appl. No.: 490,137

[22] Filed: Apr. 29, 1983

[51] Int. Cl.[3] ..... E21B 1/00; F01L 21/04

[52] U.S. Cl. ..... 173/4; 173/135; 173/138; 173/162 R; 91/229

[58] Field of Search ..... 173/134, 4, 162 R, 114, 173/138; 91/220, 224, 229, 235; 173/135

[56] References Cited

U.S. PATENT DOCUMENTS

| | | | |
|---|---|---|---|
| 678,759 | 7/1901 | Payton | 91/229 |
| 682,492 | 9/1901 | Payton | 91/229 |
| 3,010,439 | 11/1961 | Mee | 91/229 |
| 3,024,733 | 3/1962 | English | 91/229 |
| 3,851,713 | 12/1974 | Fedosenko | 173/134 |
| 3,939,755 | 2/1976 | Tabor | 91/235 |

*Primary Examiner*—James M. Meister
*Assistant Examiner*—John L. Knoble
*Attorney, Agent, or Firm*—Hubbard & Stetina

[57] ABSTRACT

A vibrationless percussion tool is disclosed characterized by use of a piston mounted for reciprocal movement against a constant pressure force within a casing to cyclically impact an anvil disposed adjacent the distal end of the casing. A spool valve is disposed within the interior of the piston and is adapted to travel in unison with the reciprocating piston except during mechanical actuation initiated adjacent the extreme downstroke and upstroke position of the piston within the casing. The constant pressure force is continuously applied to one side of the piston and by mechanical actuation of the spool valve, the volume disposed on the opposite side of the piston is alternatively vented and pressurized to cause reciprocation of the piston against the constant pressure source.

14 Claims, 8 Drawing Figures

VIBRATIONLESS PERCUSSION TOOL

TECHNICAL FIELD OF THE INVENTION

The present invention relates broadly to percussion tools and, more particularly, to an improved percussion tool which is premised upon the concept that vibrationless tool operation may be provided when a reciprocating piston adapted to cyclically impact an anvil, continuously acts, i.e., reciprocates against a constant pressure force applied to one side of the piston.

BACKGROUND OF THE INVENTION

As is well known, prior art percussion tools have been extensively utilized in the construction and manufacturing fields for such diverse applications as paving breaking, pile driving, impact hammering, and casting deburring. Basically, all prior art percussion tools are characterized by a piston or hammer mounted within a tool casing and adapted to reciprocate under the force of a pressurized working fluid such as air, hydraulic oil, or water to impact a blow striking member such as a chisel point. The actuation of the vast majority of prior art tools has typically been accomplished by various valving mechanisms adapted to alternatively vent and apply the pressurized working fluid to opposite sides the piston.

Although such prior art percussion tools have proven generally effective to accomplish their desired function, they have possessed inherent dificiencies which have detracted from their overall effectiveness in the trade. Foremost of these deficiencies has been the extremely high vibration force communicated to the operator of the tool during reciprocal movement of the piston within the casing. Such vibration force has necessarily caused discomfort to a user during initial use and after prolonged use has often resulted in permanent physical damage to the operator such as white knuckles disease. In addition, conventional prior art pneumatic percussion tools have usually been noisy in operation due to the cyclic venting of high pressure air to the work environment. Further, the operation of such conventional prior art percussion tools has typically been grossly inefficient requiring extremely high input power requirements to effectuate the resultant work product.

Although these deficiencies have recently been recognized to a limited extent in the art, the solutions to date have been directed primarily toward the mere dampening or reduction in the magnitude of sensed vibration in the percussion tool. More recently, it has been discovered that true vibration-free percussion tool operation may be effectuated by use of a constant pressure force being continuously applied to one side of the reciprocating piston against which the piston is alternatively reciprocally driven. Examples of such vibrationless prior art devices based upon this constant pressure force concept are depicted in the following U.S. Pat. Nos. 2,400,650; 2,679,826; 2,730,073; 2,752,889; 2,985,078; 3,028,840; 3,028,841; 3,200,893; 3,214,155; 3,255,832; 3,266,581; 3,291,425; 3,295,614; and 4,290,489; the disclosures of which are expressly incorporated herein by reference.

The most recent tool configuration operating on this vibrationless operation principal is U.S. Pat. No. 4,290,489—Leavell issued Sept. 22, 1981. In the particular percussion tool depicted in this U.S. Pat. No. 4,290,489 patent, vibrationless operation is obtained by use of a constant pressure force working fluid being continuously applied to one side of a reciprocating hammer while noise reduction and increased operational efficiency is provided by effectuation of a substantially adiabatic expansion of the working fluid to atmospheric pressure within the tool. Valving of the working fluid within this particular tool is facilitated by a spring biased pressure actuated poppet which selectively vents and pressurizes the volume disposed on the opposite side of the hammer acting against the constant pressure force.

Although this particular U.S. Pat. No. 4,290,489 tool structure comprises a landmark invention which can only be construed as the current state of the art in vibrationless percussion devices, the tool has proven rather cost prohibitive which has prevented its complete obsolescence of conventional prior art tools in the marketplace. Further, the use of a spring biased pressure activated poppet member has yielded moderate fatigue failure concerns and has somewhat limited the reciprocation frequency or speed of the tool.

SUMMARY OF THE PRESENT INVENTION

The present invention incorporates the basic vibrationless operation concepts disclosed in U.S. Pat. No. 4,290,489 but makes a dramatic departure from the teachings of the same by deployment of a reciprocal spool valve disposed within the interior of the piston of the tool which is mechanically actuated during reciprocal travel of the piston. As such, it has been found that increased piston reciprocation frequency or speed can be achieved while eliminating the valve fatigue failure concerns heretofore associated in vibrationless percussion tools.

More particularly, the present invention comprises a vibrationless percussion tool such as a hand held chipper or paving breaker, having a casing and a piston mounted for reciprocal movement therein. A spool valve is disposed within the interior of the piston and an anvil is positioned adjacent the distal end of the casing for connection to a chisel point or the like, for contact with a working surface. The casing and piston are provided with various fluid ports for applying constant fluid pressure to one side of the piston. In addition, the spool valve includes various fluid ports which extend radially inward to a central bore or aperture. By movement of the spool valve within the piston, the volume within the casing disposed on the opposite side of the piston is selectively and alternatively pressurized and vented to cause reciprocation of the piston within the casing against the constant pressure force.

Due to the use of the reciprocal spool valve within the interior of the piston which travels in unison with the piston except during mechanical actuation adjacent the extreme downstroke and upstroke position of the piston, valving is positive and not dependent upon pressure equalization lag or inherent hysteresis encountered within pressure activated tools thereby increasing the frequency or speed of the piston against the anvil.

Further, due to the valving of the tool being mechanically actuated, the use of a poppet biasing spring within the valve mechanism has been eliminated with the attended elimination of fatigue failure concerns. In addition, due to mechanical valve actuation, volume differentials within the tool are of less concern, thereby enabling machine tolerances within the fabricated parts of the tool to be relaxed resulting in decreased production and fabrication costs.

DESCRIPTION OF THE DRAWINGS

These as well as other features of the present invention will become more apparent upon reference to the drawings wherein.

DETAILED DESCRIPTION OF THE PREFERRED EMBODIMENT

Figures 1, 2, 3:
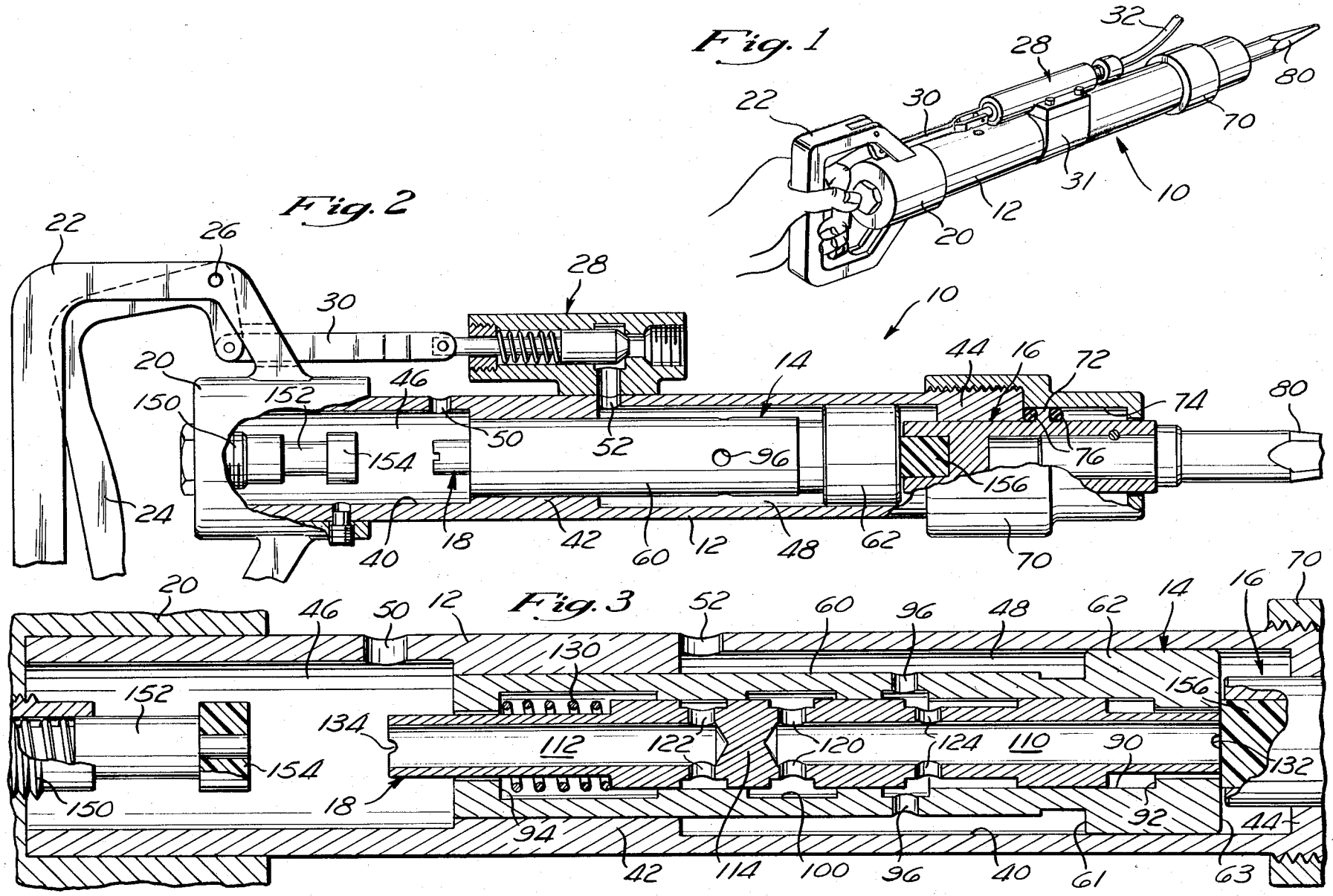
FIG. 1 is a perspective view of the improved vibrationless percussion tool of the present invention.
FIG. 2 is a partial cross-sectional view of the percussion tool of the present invention illustrating the detailed construction of the casing, piston, and anvil.
FIG. 3 is an enlarged cross-sectional view depicting the detailed construction of the piston and spool valve disposed within the interior of the piston.

Referring to FIG. 1, there is shown the improved vibrationless percussion tool of the present invention designated generally by the numeral 10. Merely by way of example and not limitation, the particular tool 10 depicted in the drawings comprises a hand-held chipper device utilzed, for instance, in casting deburring applications. However, those skilled in the art will recognize that the invention is additionally applicable to the broad spectrum of percussion tools such as paving breakers, pile drivers, pneumatic hammers, and the like and for purposes of this application, the term "percussion tool" shall include all percussion tools utilizing a reciprocal piston adapted to apply an impact force unto a working surface.

Referring more particularly to FIGS. 1 through 3, the tool 10 is composed generally of a casing 12 having a piston or hammer 14, anvil 16, and spool valve 18 disposed axially therein. The distal end of the casing 12 includes an end cap 20 rigidly mounted thereto which may additionally include a handle 22 adapted to be grasped by a user (not shown). In the particular hand chipper embodiment of the tool 10, an L-shaped lever member 24 may be pivotally mounted to the handle 22 as by way of a pivot pin 26, which lever actuates a spring biased normally closed valve 28 via a linkage 30. The valve 28 is affixed to the casing 12 as by way of a yoke 30 and connected via a conduit or hose 32 to a source of pressurized working fluid (not shown). Although in the preferred embodiment the working fluid comprises compressed air, those skilled in the art will recognize that other working fluids such as hydraulic oil, water, and the like may be utilized. During manual actuation of the lever 24, the normally closed valve 28 is moved to an open position to allow flow of the compressed fluid through the valve 28 and into the interior of the casing 12.

The casing 12 is formed having a generally elongate cylindrical configuration preferably fabricated of a high strength aluminum or steel material. A central aperture or cylinder wall 40 extends axially throughout the length of the casing 12 and includes a pair of reduced diameter sections 42 and 44 which segregate the aperture 40 into a vent control chamber 46 and piston control chamber 48. The vent control chamber 46 is in constant communication with atmosphere through an outlet port 50 formed through the casing 12 while the piston control chamber 48 is constantly exposed to the working fluid through an inlet port 52 and the spring biased valve 28.

The piston or hammer 14 comprises a cylindrical member having an elongate portion 60 and impact or head portion 62. The outside diameter of the elongate portion 60 is sized to be equal to or slightly less than the diameter of the aperture 40 in the piston control chamber 48 such that the piston 14 may axially reciprocate in a close sliding fit throughout the length of the piston control chamber 48 while preventing any direct flow communication between the vent control chamber 46 and piston control chamber 48. Similarly, the maximum diameter of the head portion 62 of the piston 14 is sized to permit a close sliding fit between the head portion 62 and the cylinder wall 40 of the casing 12.

The anvil 16 is disposed adjacent the distal end of the casing 12 and is retained thereon by a retainer cap 70 preferably threadedly mounted onto the casing 12. The anvil 16 is formed in a generally cylindrical configuration, the main outside diameter of which is slightly less than the diameter of the reduced diameter portion 44 of the aperture 40 whereby the anvil 16 may reciprocate axially along the length of the reduced diameter portion 44 of the cylinder wall 40. An annular shoulder 72 extends radially outward from the main outside diameter of the anvil 70 which is sized to have a maximum diameter slightly less than the diameter of an aperture 74 formed in the distal end of the retainer 70. As such, the anvil 16 is free to axially reciprocate throughout the length of the aperture 74 of the retainer cap 70 with the annular shoulder 72 forming a mechanical stop at the distal ends of the aperture 74. A pair of O-rings 76 may additionally be provided on opposite sides of the annular shoulder 72 to dampen the impact of the shoulder 72 against the distal ends of the aperture 74. The anvil 16 is preferably provided with an aperture 78 extending axially inward from its distal end which mounts a chisel point or the like 80 adapted for contacting a working surface.

Referring more particularly to FIG. 3, the piston 14 includes a central aperture 90 which extends axially throughout its length having a pair of annular shoulders 92 and 94 adjacent its distal ends. Plural apertures or inlet ports 96 are additionally provided in an elongate portion 60 of the piston 14 to permit fluid communication between the piston control chamber 48 and interior of the aperture 90. An increased diameter portion or recess 100 is additionally provided intermediate the length of the aperture 90.

The spool valve 18 is disposed within the aperture 90 formed in the piston 14 preferably having an axial length greater than the overall length of the piston 14. The maximum diameter of the spool valve is equal to or slightly less than the diameter of the aperture 90 such that the valve 18 may reciprocate axially along the length of the aperture 90. A pair of elongate apertures 110 and 112 extend axially inward from opposite ends of the spool valve 18 terminating at a plug or wall 114 formed within the interior of the spool valve 18. A pair of ports 120 and 122 are disposed on opposite sides of the plug 114 and extend radially inward from the outside diameter of the spool valve 18 into the elongate apertures 110 and 112, respectively. An additional pair of ports 124 are provided in the spool valve 18 extending radially inward from its diameter into the elongate aperture 110.

A spring 130 is provided adjacent the distal end of the spool valve 18 which as will be explained in more detail infra, serves to provide a moderate biasing force to the spool 18 to urge the spool 18 toward the anvil 16 during the downstroke of the piston within the casing. The distal ends of the spool 18 additionally include one or more recesses 132 and 134 extending radially outward from the exterior of the spool valve 18 into the elongate apertures 110 and 112, respectively.

The end cap 20 is preferably provided with a threaded plug 150 which extends axially within the upper control chamber 46. The plug 150 mounts a spring biased plunger 152 which terminates in a cylindrical pad or disk 154. A simliar pad or disk 156 is mounted within the distal end of the anvil 16. Both disks 154 and 156 are preferably formed of a resilient material such as polytetrafluoride, polyurethane, or rubber and have a diameter sized slightly greater than the diameter of the end portions of the spool valve 18. As will be explained in more detail infra, during reciprocation of the piston 14 within the casing 12, these pads 154 and 156 contact the distal ends of the spool valve 18 to mechanically actuate the spool valve 18. Due to the disks 154 and 156 being formed of a resilient material, permanent deformation or mushrooming of the ends of the spool valve 18 is thereby reduced.

With the structure defined, the operation of the improved vibrationless percussion tool 10 of the present invention may be described, reference being had to FIGS. 4 through 8 which depict the operation of the tool 10 through a complete upstroke and downstroke operation cycle. For purposes of the description, it will be assumed that the spring biased valve 28 is continuously maintained in a open position such that constant fluid pressure is applied through the port 52.

Figure 4:
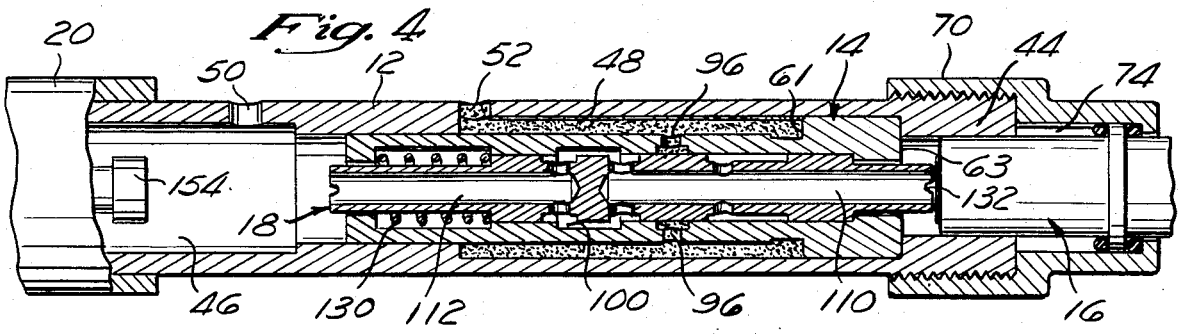
FIG. 4 is a cross-sectional view depicting the percussion tool of the present invention in a stand-by operational condition.

In FIG. 4, the tool 10 is depicted in a standby operational condition with the high pressure fluid (indicated by shading in FIGS. 4 through 8) being applied to the annular shoulder 61 of the piston 14 to drive the piston 14 from left to right to its maximum downstroke position wherein the annular face 63 of the piston 14 abuts the decreased diameter portion 44 of the casing 12. In this standby operational condition, it will additionally be noted that the anvil 16 is positioned in its furthermost downstroke position within the aperture 74 formed in the retainer 70. Additionally, the spool valve 18 is axially positioned within the piston 14 to block the ports 96 formed in the piston 14 thereby preventing the high pressure fluid from entering into the elongate aperture 110 formed in the spool valve 18. Similarly, in this axial position of the spool valve 18, the volume located beneath the annular shoulder 63 of the piston 14 is vented through the central aperture 110, increased diameter portion 100, elongate aperture 112, vent control chamber 46, and port 50 to atmosphere. Thus, it will be recognized that this standby condition will exist irrespective of the existence or nonexistence of high pressure fluid being applied to the port 52 such that in some applications, the spring bias valve 28 can be eliminated with the port 52 being in direct communication with high pressure fluid source.

Figure 5:
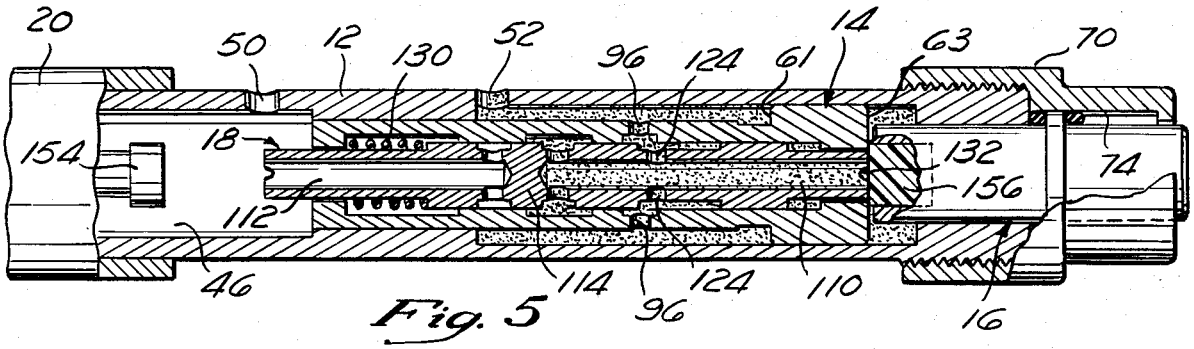
FIG. 5 is a cross-sectional view depicting the percussion tool of the present invention in its initial upstroke operating condition.

Referring to FIG. 5, the tool 10 is placed in an operative position by reciprocating the anvil 16 from right to left (as viewed in FIG. 5) throughout the length of the aperture 74 formed in the retainer cap 70 as by way of manually pressing the anvil 16 tightly against a working surface (not shown). During this reciprocal movement of the anvil 16, the pad 156 disposed on the distal end of the anvil 16 contacts the distal end of the spool valve 18 and upon overcoming the minor biasing force of the spring 130, drives the spool valve 18 from right to left (as viewed in FIG. 5). Due to the high pressure fluid source being applied to the annular shoulder 61 of the piston 14, the piston 14 is maintained in a stationary position while the spool valve 18 reciprocates axially from right to left.

As the spool valve 18 is reciprocated, the inlet ports 96 formed through the piston 14 communicate with or are open to the elongate aperture 110 through the ports 124 formed in the spool valve 18 while the plug 114 of the spool valve 18 blocks any flow communication between the elongate apertures 110 and 112 through the increased diameter portion 100 of the anvil 14. Thus, the high pressure fluid travels within the interior of the elongate aperture 110, through the radial extending recess 132 formed on the distal end of the spool valve 18 and is applied to the opposite side of the piston 14 across its annular face 63. To allow the high pressure to be rapidly applied to the opposite side of the piston 14, the annular face 63 preferably includes one or more radially extending recesses (not shown) which permit the high pressure fluid to initially travel between the annular face 63 and resilient disk 156.

Due to the cross-sectional area of the annular surface 63 being greater than the cross-sectional area of the annular surface 61, the piston 14 will begin to reciprocate axially from right to left (as viewed in FIG. 5) and begin its upstroke movement. As will be recognized, during upstroke, the piston 14 reciprocates against the constant fluid pressure force being applied against the annular shoulder 61 and solely due to the difference in surface area between the annular shoulder 61 and annular shoulder 63.

Figure 6:
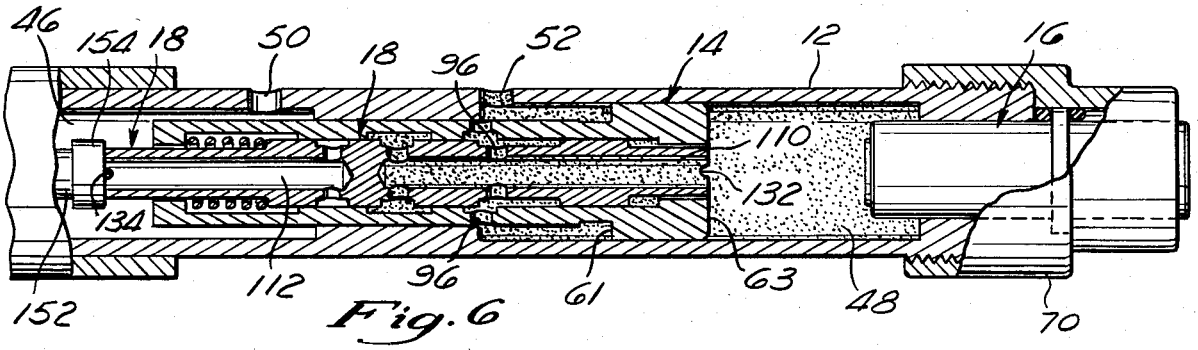
FIG. 6 is a cross-sectional view depicting the piston of the percussion tool of the present invention in an intermediate upstroke operation position.

During this upstroke movement, it will be recognized that the spool valve 18 travels or reciprocates in unison with the piston 14 (as depicted in FIG. 6) such that the plug portion 114 of the spool valve 18 continues to prevent any application of high pressure fluid into the elongate aperture 112. In addition, it will be recognized that during upstroke, the vent control chamber 46 is vented to atmosphere through the open port 50 such that the upstroke of the hammer 14 is not impeded.

Figure 7:
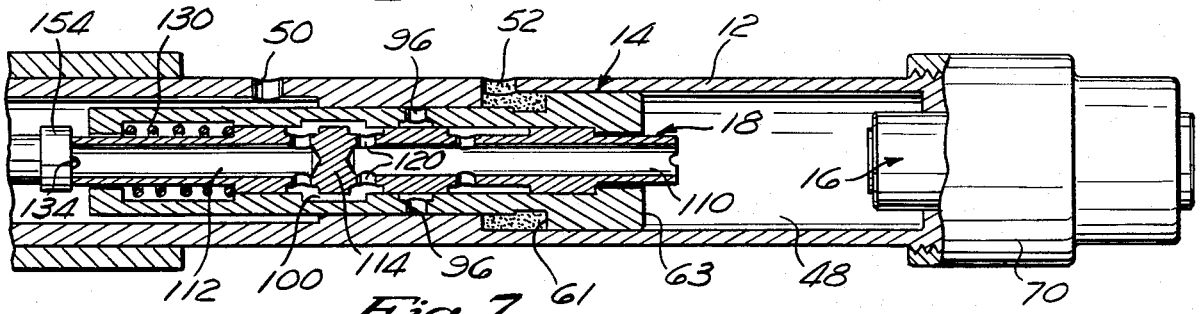
FIG. 7 is a cross-sectional view depicting the piston in its maximum upstroke position.

When the piston 14 reciprocates to a position illustrated in FIG. 6, the opposite distal end of the spool valve 18 abutts the disk 154 positioned on the threaded plunger 152. Upon contacting the plunger 154, the spool valve 18 will remain stationary (i.e. not travel with the piston 14) whereby continued upstroke of the piston 14 causes the spool valve 18 to reciprocate from left to right relative the piston 14 (as depicted in FIG. 7). In addition, continued upstroke of the piston 14 causes the inlet ports 96 of the piston 14 to travel axially beyond the location of the inlet port 52 formed in the casing 12 such that the high pressure fluid source is discontinued from passage through the elongate aperture 110. This discontinuance of the high pressure fluid into the elongate aperture 110 thereby serves to reduce the upstroke force applied to the piston 14. As such, further upstroke of the piston 14 from the position indicated in FIG. 6 to that indicated in FIG. 7 continues only until such time as the effective force acting upon the annular shoulder 63 of the piston 14 equals the effective force of the high pressure fluid acting upon the annular shoulder 61.

Figure 8:
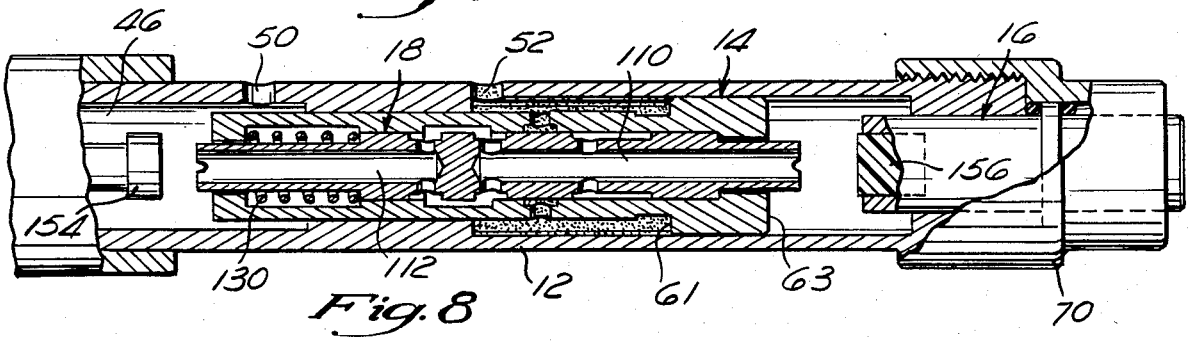
FIG. 8 is a cross-sectional view depicting the piston in its intermediate downstroke position.

Through continued upstroke, the spool valve 18 reciprocates from left to right until such time as the plug portion 114 of the spool valve 18 is axially aligned with the enlarged diameter portion 100 formed within the interior of the piston 14. As soon as the spool valve 18 is mechanically actuated to this position (as indicated in FIG. 7), the volume of the piston control chamber 48 located on the opposite side of the piston 14 is rapidly vented through the elongate aperture 110, spool ports 120, enlarged diameter section 100, spool ports 122, and into the elongate aperture 112. Due to the inclusion of the annular recess 134 on the distal end of the spool valve 18, this pressure is further vented to atmosphere through the port 50 located in the casing 12. Upon the piston 14 obtaining a maximum upstroke position as indicated in FIG. 7, the high pressure fluid being applied to the annular face 61 of the piston 14 causes the piston 14 to begin its downstroke as depicted in FIG. 8. During downstroke, the moderate biasing force of the spring 130 positioned on the distal end of the spool 18 serves to maintain the spool 18 in its previously actuated position (i.e. the position indicated in FIG. 7) such that the volume of the piston control chamber 48 residing beneath (i.e. to the right) of the annular shoulder 63 of the piston 14 is continuously vented to atmosphere during the downstroke.

The piston 14 therefore rapidly accelerates from left to right (as viewed in FIG. 8) under the pressure force exerted against the annular shoulder 61 of the piston 16 through the full downstroke length to impact the distal end of the anvil 16 and thereby impart a motive force to the anvil 16 and its chisel point 80.

As will be recognized, just prior to impact of the annular face 63 of the piston 14 against the distal end of the anvil 16, the distal end of the spool valve 14 will again contact or abut the disk 156 positioned in the anvil 16. Due to the spool valve 18 being readily reciprocal within the interior of the piston 14, the downstroke of the piston 14 is not prohibited by this contact but rather, the spool valve 18 merely reciprocates from right to left as viewed in FIG. 8 such that full impaction force of the piston 14 upon the anvil 16 is effectuated. After impact and with the spool valve 18 being reciprocated back to its position shown in FIG. 5, the above described upstroke and downstroke cycle of the piston 14 may be repeated as desired.

From the above, it will be recognized that throughout the upstroke and downstroke of the piston 14, high pressure fluid is continuously applied to the annular surface 61 of the piston 14. This constant pressure force being applied to the piston 14 in effect forms a floating piston arrangement which has been found to eliminate sensible vibration in the casing 12 and handle 22 of the tool 10. Further, due to the spool valve 18 traveling or riding in unison with the piston 14 except during actuation adjacent the maximum upstroke and downstroke position of the piston 14, it has been found that the frequency or speed of the reciprocation cycle of the piston 14 may be substantially increased over previous pressure actuated valving mechanisms. In addition, it will be recognized that the plunger pin 152 of the tool 10 permits the precise moment of actuation of the spool valve 18 during the upstroke cycle of the piston 14 to be adjusted by varying the location of the disk 154 within the vent control chamber 46.

Although in the preferred embodiment certain material and component configurations have been defined, those skilled in the art will recognize that modification to the same may be readily made without departing from the spirit of the present invention and such modifications are clearly contemplated herein.

What is claimed is:

1. A vibrationless percussion tool comprising:

a casing in which vibrations are undesirable, said casing including a vent control chamber in constant communication with the atmosphere and a piston control chamber having a first portion and a second portion;

an anvil positioned adjacent one end of said casing adapted to transmit an applied impact force to a working surface;

means for applying a pressurized fluid into said casing;

a piston reciprocally mounted for upstroke and downstroke travel within said casing having a first surface continuously exposed to the pressurized fluid and a second surface, larger than the first surface, intermittently exposed to the pressurized surface and adapted to impact said anvil, said piston having a central passage therein; and a mechanically actuated valve disposed within the interior of said piston and mounted to reciprocally travel in unison with said piston except during mechanical actuation adjacent the extreme upstroke and downstroke position of said piston within said casing, said mechanically actuated valve comprising a spool valve mounted within said central passage between a first stop adjacent a first end of said piston and a second stop adjacent a second end of said piston, said spool valve including a first valve passage in fluid communication with said vent control chamber and a second valve passage in fluid communication with said second portion of said piston control chamber, said first and second valve passages extending axially into said spool valve, said spool valve including a wall separating said first and second valve passages to prevent direct fluid flow therebetween, said first valve passage including a first port adjacent said wall for providing fluid flow into and out of said first valve passage, said second valve passage including a second port adjacent said wall for providing fluid flow into and out of said second valve passage, said spool valve upon contacting said first and second stops, alternately venting and applying the pressurized fluid to the second surface of said piston to reciprocate said piston against the pressurized fluid continuously applied to the first surface of said piston.

2. The percussion tool of claim 1 wherein the axial length of said spool valve is greater than the axial length of said piston.

3. The percussion tool of claim 2 wherein said first and second stops comprise a resilient material.

4. The percussion tool of claim 3 wherein one of said stops is mounted upon an end of said anvil.

5. The percussion tool of claim 4 wherein the other one of said stops is mounted to said casing by means for adjusting the axial location of said stop to varying the position of actuation of said spool valve within said casing.

6. The percussion tool of claim 5 wherein said anvil is mounted to said casing by a retainer cap adapted to permit said anvil to axially reciprocate relative to said end of said casing.

7. The percussion tool of claim 6 wherein said anvil is formed to mount a work member formed to directly contact a working surface.

8. A vibrationless percussion tool comprising:

a casing in which vibrations are undesirable, said casing including a vent control chamber in constant communication with the ambient atmosphere and a piston control chamber having a first portion and a second portion;

an anvil mounted adjacent one end of said casing for transmitting an impact force to a working surface;

a piston reciprocally mounted for upstroke and downstroke travel within said casing, said piston having a first surface continuously exposed to the pressurized fluid and a second surface, larger than the first surface, intermittently exposed to the pressurized surface and adapted to impact said anvil, said piston having a central passage extending axially throughout the length thereof;

means for applying a constant pressure force continuously upon said first surface of said piston; and a spool valve mounted within said central passage of said piston and carried by said piston between a first stop and a second stop, said spool valve including a first valve passage and a second valve passage, said first and second valve passages extending axially into said spool valve, said spool valve including a wall separating said first and second valve passages to prevent fluid flow therebetween, said first valve passage including a first port adjacent said wall for providing fluid flow into and out of said first valve passage, said second valve passage including a second port adjacent said wall for providing fluid flow into and out of said second valve passage, said central passage in said piston having a first reduced diameter portion for forming fluid-tight seals with said wall separating said first and second valve passages to prevent said first and second valve passages to prevent fluid flow therebetween, said central passage having an increased diameter portion between said reduced diameter portions to permit fluid flow around said wall when said wall is within said increased diameter portion to vent said second portion of said piston control chamber, thereby causing the fluid pressure in the first portion of said piston control chamber to reciprocate said piston against said anvil, said spool valve upon contacting said first and second stops applying the constant pressure force to said second surface of said piston to drive said piston in an upstroke direction against the constant pressure force continuously applied to said first surface of said piston and venting the constant pressure force applied to said second surface of said piston to drive said piston in a downstroke direction under the constant pressure force continuously applied to said first surface of said piston to impact said anvil.

9. The percussion tool of claim 8 wherein the axial length of said spool valve is greater than the axial length of said piston.

10. The percussion tool of claim 8 wherein said second stop is mounted upon one end of said anvil.

11. The percussion tool of claim 10 wherein the other one of said stops is mounted within said casing by means for adjusting the axial position of said other one of said stops relative the distal end of said spool valve.

12. The percussion tool of claim 11 wherein said anvil is mounted to said casing by a retainer cap adapted to permit said anvil to axially reciprocate relative the one end of said casing.

13. The percussion tool of claim 12 further comprising a work member mounted to said anvil for implementing the impact force against the working surface.

14. The percussion tool of claim 13 wherein said pressure force applying means additionally includes a trigger actuated valving member adapted to selectively discontinue the application of said constant pressure force upon said first surface of said piston.

* * * * *